US008622174B2

(12) United States Patent
Bai

(10) Patent No.: US 8,622,174 B2
(45) Date of Patent: Jan. 7, 2014

(54) ESCAPE DEVICES FOR HIGH-RISE BUILDINGS

(76) Inventor: Xiaolin Bai, Sichuan (CN)

( * ) Notice: Subject to any disclaimer, the term of this patent is extended or adjusted under 35 U.S.C. 154(b) by 506 days.

(21) Appl. No.: 12/919,898

(22) PCT Filed: Mar. 2, 2009

(86) PCT No.: PCT/CN2009/070606
§ 371 (c)(1),
(2), (4) Date: Nov. 10, 2010

(87) PCT Pub. No.: WO2009/106018
PCT Pub. Date: Sep. 3, 2009

(65) Prior Publication Data

US 2011/0042167 A1 Feb. 24, 2011

(30) Foreign Application Priority Data

Feb. 29, 2008 (CN) ..... 2008 1 0065491

(51) Int. Cl.
*A62B 1/02* (2006.01)

(52) U.S. Cl.
USPC ..... 182/145

(58) Field of Classification Search
USPC ..... 182/82, 142, 145; 187/290, 401, 406, 187/900
See application file for complete search history.

(56) References Cited

U.S. PATENT DOCUMENTS

| | | | | |
|---|---|---|---|---|
| 4,433,752 | A * | 2/1984 | G/u/ nter | 182/82 |
| 4,887,694 | A * | 12/1989 | Ho | 182/82 |
| 5,671,824 | A * | 9/1997 | Keegan et al. | 182/82 |
| 2004/0206574 | A1 * | 10/2004 | Richey et al. | 182/82 |
| 2005/0269155 | A1 * | 12/2005 | Chen | 182/82 |
| 2006/0144639 | A1 * | 7/2006 | Iacoviello, Jr. | 182/82 |

FOREIGN PATENT DOCUMENTS

| | | | |
|---|---|---|---|
| CN | 1358550 | | 7/2002 |
| CN | 2776454 | | 5/2006 |
| CN | 1990064 | | 7/2007 |
| CN | 101077439 | | 11/2007 |
| JP | 2001-286571 | A | 10/2001 |
| JP | 2007062896 | A * | 3/2007 |

OTHER PUBLICATIONS

International Search Report for PCT/CN2009/070606, completed May 21, 2009.

* cited by examiner

*Primary Examiner* — Katherine Mitchell
*Assistant Examiner* — Kristine Florio
(74) *Attorney, Agent, or Firm* — Barnes & Thornburg LLP

(57) ABSTRACT

An escape device for high-rise buildings includes an escape capsule, a speedup gear mounted to the escape capsule, a track provided with a rack with which the speedup gear is engaged so that the escape capsule can move along the track, and a damper including a rotor. The speedup gear in operation drives the rotor into rotation and the damper is capable of converting a portion of kinetic energy of the escape capsule to the electric energy. The escape device can be braked at any position at a building.

14 Claims, 6 Drawing Sheets

ESCAPE DEVICES FOR HIGH-RISE BUILDINGS

CROSS REFERENCE OF RELATED APPLICATIONS

This application is a U.S. national application under 35 U.S.C. §371(b) of international Application Ser. No. PCT/CN2009/070606 filed Mar. 2, 2009, which claims the benefit of Chinese Patent Application No. 20081006549.1, filed Feb. 29, 2008, the disclosures of both of which are hereby incorporated herein by reference.

TECHNICAL FIELD

The present invention relates to a carrier, more particularly to a device for carrying people or other objects.

BACKGROUND OF THE INVENTION

Many disasters such as fires, earthquakes and terrorist attacks seriously threaten people's safety. In the event of a disaster, sometimes rescue personnel cannot timely arrive. Therefore, a useful self-help crowd escape device is especially required for high-rise buildings to carry trapped persons or other objects.

SUMMARY OF THE INVENTION

In one embodiment, provided is an escape device for high-rise buildings, which comprises: an escape capsule; a speed up gear mounted to the escape capsule; a track provided with a rack with which the speed up gear is engaged so that the escape capsule can move along the track; and a damper including a rotor, wherein the speed up gear in operation drives the rotor into rotation and the damper is capable of converting a portion of kinetic energy of the escape capsule to electric energy.

According to another embodiment, it is to provide an escape system for high-rise buildings comprising two escape devices, wherein each of the escape devices comprises: an escape capsule; a speed up gear mounted to the escape capsule; a track provided with a rack with which the speed up gear is engaged so that the escape capsule can move along the track; and a damper including a rotor, wherein the speed up gear in operation drives the rotor into rotation and the damper is capable of converting a portion of kinetic energy of the escape capsule to electric energy.

The escape device for high-rise buildings provided herein has at least one of the following effects. By using the speed up gear, the persons' potential energy can be converted to kinetic energy to be input into the damper. Then, the damper converts the kinetic energy to electric energy in real time so as to slow down the escape capsule and not to need any power supply. The obtained electric energy can be stored or consumed by a resistor. Since the movement of the escape capsule is limited by one or more tracks, the running of the escape capsule may not be influenced by the wind. The security and stability of the escape device of the present invention are improved. Two escape capsules of the escape device can be used circularly to carry a crowd of trapped persons. The escape device can be stopped at any position at a building.

DETAILED DESCRIPTION OF THE INVENTION

Hereinafter, a detailed description of the present invention will be given with reference to the appended drawings and embodiments.

Figure 1:
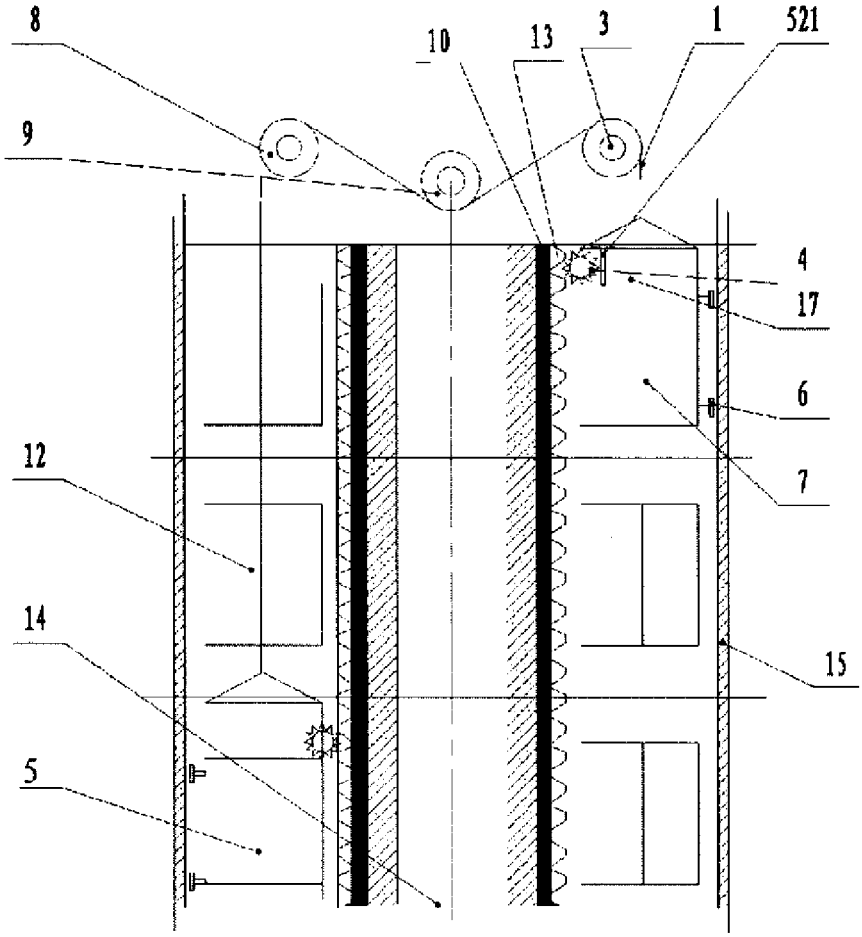
FIG. 1 shows a schematic diagram illustrating an escape device for high-rise buildings according to an embodiment of the present invention.
Figure 2:
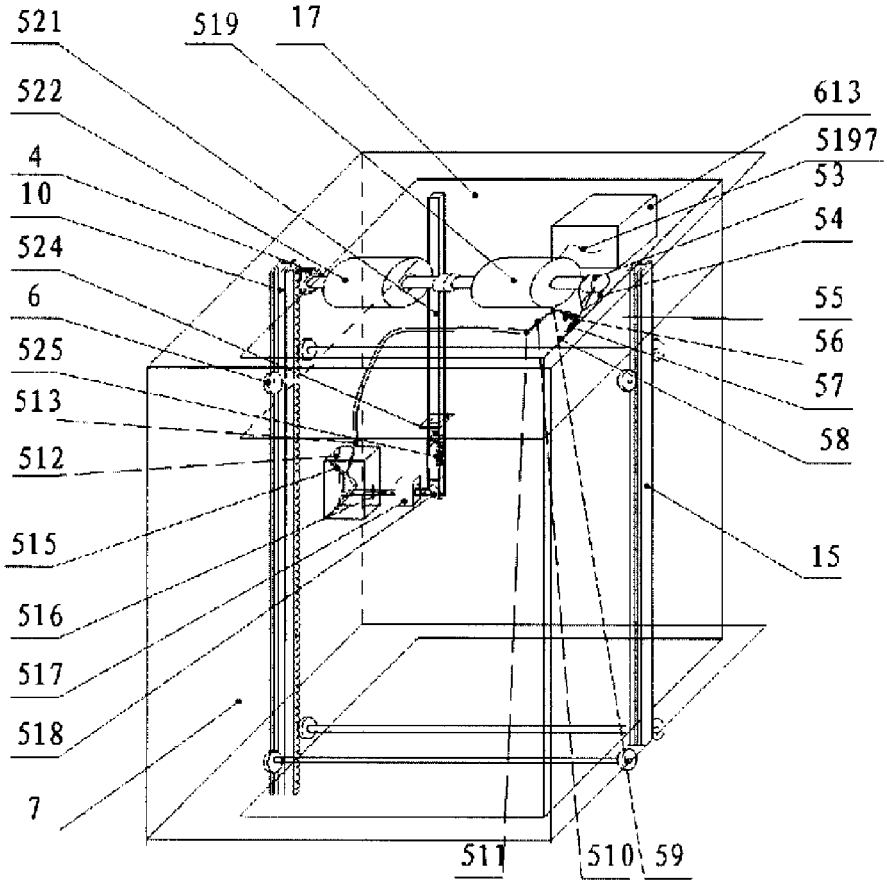
FIG. 2 shows a schematic diagram illustrating the first escape capsule, the speed-control capsule, the brake assembly and the emergency stop mechanism according to an embodiment of the present invention.

An escape device for high-rise buildings disclosed herein can be used to rapidly carry persons trapped in a high-rise building down to the ground in the event of disasters such as fires, earthquakes, terrorist attacks and so on. As shown in FIGS. 1 and 2, the escape device for high-rise buildings comprises a first escape capsule 7, a first damper 519, a first track 10 and a second track 15. The first escape capsule 7 for carrying the trapped persons can move along a first channel formed between the first track 10 and the second track 15 so as to move to the ground or the roof of the building in a predetermined path. In this way, the movement of the first escape capsule 7 may not be influenced by the surrounding such as wind. A first rack 13 is installed on at lease one of the first and second tracks 10 and 15. In this embodiment, the first rack 13 is installed to the first track 10. A first speed up gear 4 engaged with the first rack 13 is provided in the first escape capsule 7. The first speed up gear 4 in operation can drive a rotor of the first damper 519 into rotation and the first damper 519 can control the rotation of the first speed up gear 4 through a transmission mechanism so as to control the speed of the first escape capsule 7, the principle of which will be described in detail later.

As shown in FIG. 2, in this embodiment, the transmission mechanism is a first speed up mechanism 522. In an implementation, the first speed up mechanism 522 is, for example, a cycloidal pin gear speed-up mechanism. A speed-control capsule 17 is provided on the top of the first escape capsule 7. The first damper 519, the first speed up mechanism 522 and the first speed up gear 4 are installed in the speed-control capsule 17. The first damper 519 is provided to restrict the acceleration of the first escape capsule 7 when the first escape capsule 7 descends.

In an embodiment, the escape device for high-rise buildings according to the present invention may further comprise a brake assembly used to slow down or stop the motion of the first escape capsule 7. By using the brake assembly, the first escape capsule 7 can be automatically stopped at the roof of the building or manually stopped at any floor of the building.

Figure 3:
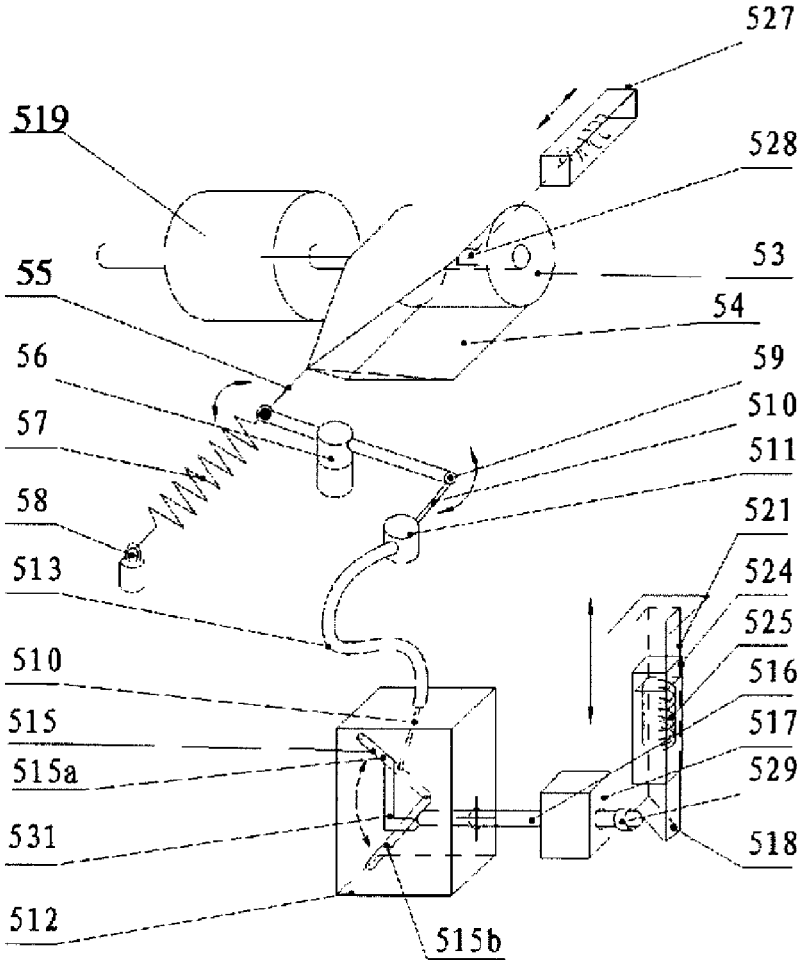
FIG. 3 shows a schematic diagram illustrating the brake assembly and the emergency stop mechanism according to an embodiment of the present invention.

As shown in FIGS. 2 and 3, the brake assembly may comprise a brake wheel 53, a brake-belt 54, a brake-belt pulling rod 55, a brake-belt positioning rod 527, a rotating-arm 59, a rotating-arm fixing latch 56, a tension-spring 57, a tension-spring fixing latch 58, a pull-cable 510, a pull-cable tube 513, an tube end fixing element 511, a brake operating box 512 and an operating handle 515. Hereinafter, the connection and operation of the components of the brake assembly will be described in detail.

The brake wheel 53, the brake-belt 54, the brake-belt pulling rod 55, the brake-belt positioning rod 527, the rotating-arm 59, the rotating-arm fixing latch 56 and the tension-spring 57 may be disposed within the speed-control capsule 17. As shown in FIG. 3, a first end of the stretched tension-spring 57 can be fixedly connected to the tension-spring fixing latch 58, and a second end of the tension-spring 57 is connected with a first end of the rotating-arm 59 and a first end of the brake-belt pulling rod 55. The rotating-arm 59 can rotate about the rotating-arm fixing latch 56 so as to stretch the tension-spring 57. When the rotating-arm 59 is rotated to a stop position, the brake-belt pulling rod 55 connected with the brake-belt 54 is pulled by the tension-spring 57. The brake-belt 54 partially surrounds the brake wheel 53. In this case, the brake-belt 54 is pulled by the brake-belt pulling rod 55 so as to clasp the brake wheel 53. On the contrary, when the rotating-arm 59 is rotated to an operation position, the brake-belt pulling rod 55 is pushed by the rotating-arm 59. In this case, the brake-belt 54 is released by the brake-belt pulling rod 55 so as to release the brake wheel 53. The brake-belt positioning rod 527 is movably connected with the brake-belt 54 at the joint 528 for preventing the brake-belt 54 from falling away from the brake wheel 53 so as to ensure that the brake-belt 54 and the brake wheel 53 properly fit with each other. The combination of the tension-spring 57, the rotating-arm 59, the brake-belt pulling rod 55 and the operating handle 515 forms a brake operator for use.

According to the present embodiment, the rotation of the rotating-arm 59 is controlled by the operating handle 515 through the pull-cable 510 which is enclosed by the pull-cable tube 513 fixed by the tube end fixing element 511. Specifically, a first end of the pull-cable 510 is connected with a second end of the rotating-arm 59, and a second end of the pull-cable 510 is connected with the operating handle 515. The operating handle 515 is assembled in the brake operating box 512 fixed on the first escape capsule 7. The operating handle 515 is configured to extend out of the brake operating box 512 through a sliding slot 531 provided on a wall of the brake operating box 512, and is capable of moving along the sliding slot 531 and thereby switching between a brake position 515*a* and a release position 515*b*.

In operation, when the operating handle 515 is switched by a user from its brake position 515*a* to the release position 515*b*, the rotating-arm 59 is thereby rotated to its operation position due to the effect of the pull-cable 510 connected to the handle 515, in turn, the first escape capsule 7 begins to move upwards or downwards as stated above. On the contrary, when the operating handle 515 is switched by a user from its release position 515*b* to the brake position 515*a*, the rotating-arm 59 is thereby rotated to its stop position due to the effect of the tension-spring 57. Then, the first escape capsule 7 is stopped.

In an embodiment, the brake assembly may further comprise an emergency stop mechanism. The emergency stop mechanism comprises a rod positioning box 524 mounted in the first escape capsule 7, a reset spring 525 provided within the box 524, an upper brake rod 521, and a lower brake rod 518. The upper brake rod 521 and the lower brake rod 518 are slidably assembled in the rod positioning box 524. The reset spring 525 is connected between the upper and lower brake rods 521 and 518. The lower end of the lower brake rod 518 is wedge-shaped. A push-rod 516 passing through a push-rod positioning box 517 is provided with a first end thereof disposed close to the wedge-shaped surface of the lower brake rod 518. And, a second end of the push-rod 516 extends into the brake operating box 512 and is adjacent to the operating handle 515. The push-rod positioning box 517 is used to limit the movement of the push-rod 516. To prevent one end of the push-rod 516 from immerging in the through-hole 540, a sleeve 529 hoops the push-rod 516 to limit the axial movement of the push-rod 516.

When the first escape capsule 7 moves upwards, the upper brake rod 521 will first be hit by the ceiling of the building, so as to compress the reset spring 525 and in turn push the lower brake rod 518 down. The wedge-shaped surface of the lower brake rod 518 will successively push the push-rod 516 to switch the operating handle 515 from its release position 515*b* to its brake position 515*a* so that the first escape capsule 7 is stopped and held on the top floor.

Figure 4:
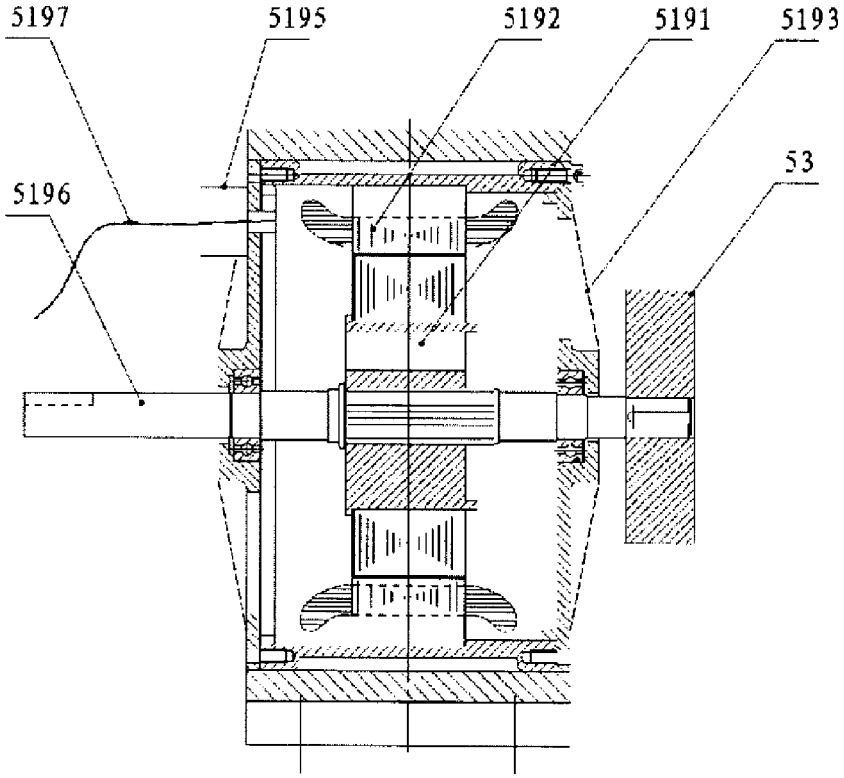
FIG. 4 shows a cross-sectional view illustrating an example of the first damper according to an embodiment of the present invention.
Figure 5:
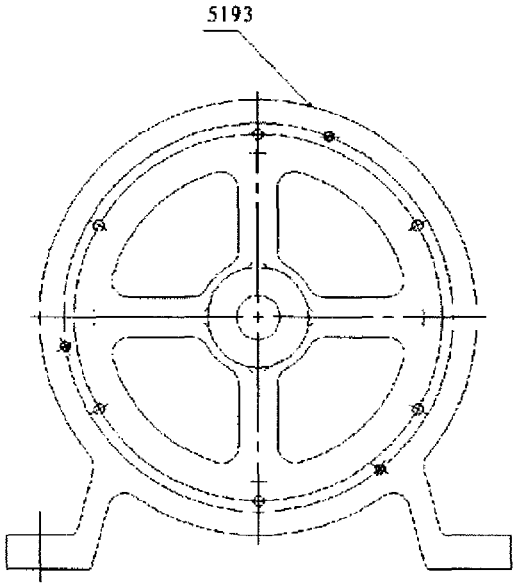
FIG. 5 shows a schematic diagram illustrating the first damper according to an embodiment of the present invention.

FIGS. 4 and 5 show an example of the first damper 519 for generating electric power and a resistant force opposite to the force produced by the gravity due to the weight of the first escape capsule 7 and the persons stood therein. The first damper 519 comprises a rotor 5191 made of a magnetic material (e.g. permanent magnetic steel), a stator 5192 including coil windings, a bearing base 5193, a outlet box 5195, a damper shaft 5196 and a three-phase wire 5197. The damper shaft 5196 is connected with a shaft of the first speed up mechanism 522 and the rotor 5191. The rotor 5191 is connected with the brake wheel 53 so that the brake and movement of the first escape capsule 7 can be controlled by clasping or releasing the brake wheel 53. The three-phase wire 5197 is leaded from the outlet box 5195 provided on the bearing base 5193 to any load. As stated above, the shaft of the first speed up mechanism 522 is connected with the rotor 5191 through the damper shaft 5196. When the first escape capsule 7 descends, the gravity due to the weight of the first escape capsule 7 and the persons stood therein drives the first speed up gear 4 to rotate so as to drive the rotor 5191 rotates at a high speed, which in turn causes a relative motion between the closed loop and the permanent magnetic field, so that electric current is generated in the closed loop due to the relative motion therebetween. In this case, a magnetic force opposite to the gravity is also produced so as to continuously balance the acceleration generated by the gravity. The speed of the first escape capsule 7 can be controlled within a preset safe speed range automatically. Thus, the first escape capsule 7 may not land onto the ground at an unsafe speed with a high kinetic energy so as to ensure the persons' safety.

Figure 6:
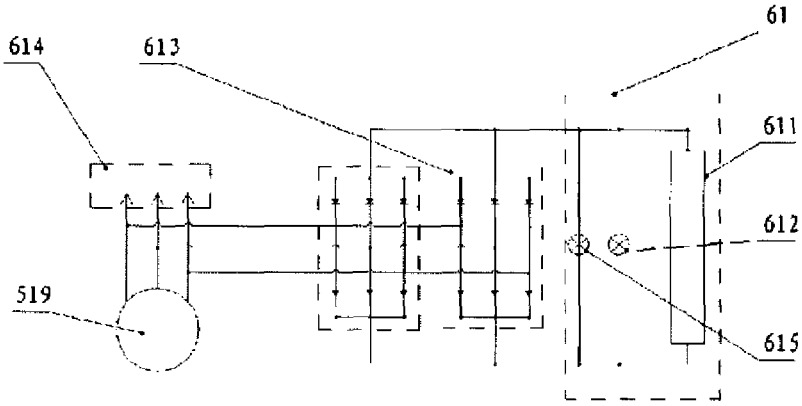
FIG. 6 shows a circuit diagram of the automatic speed-control system according to an embodiment of the present invention.
Figure 7:
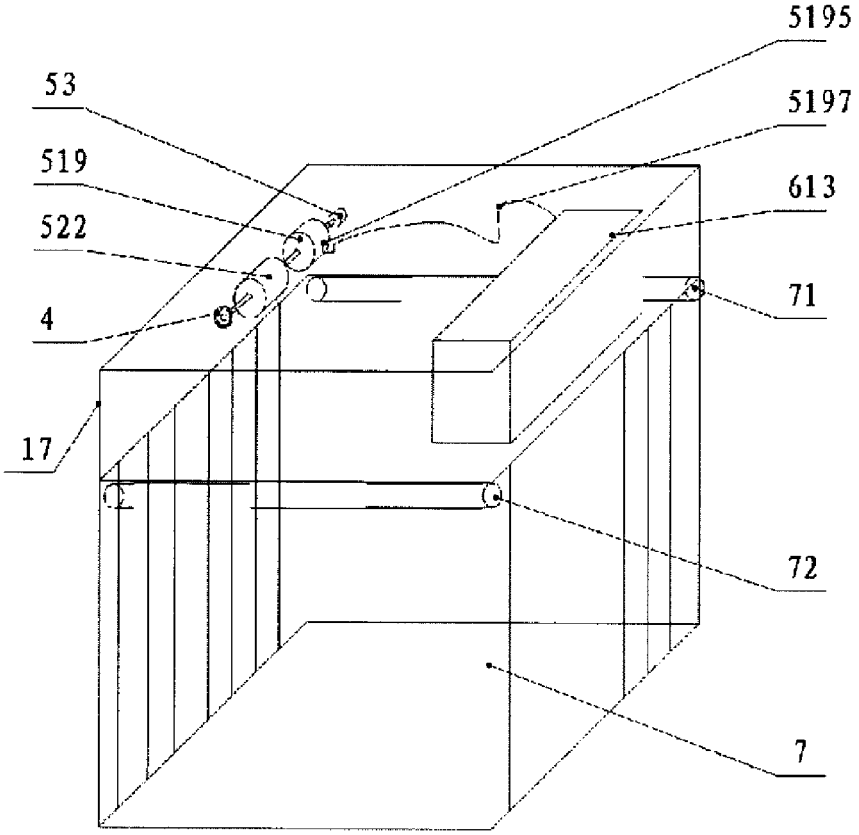
FIG. 7 shows a schematic diagram illustrating the first escape capsule and the speed-control capsule according to an embodiment of the present invention.

As shown in FIG. 6, the escape device for high-rise buildings may further comprises an energy-consumption assembly 61 and a rectifier assembly 613. The rectifier assembly 613 is placed in the speed-control capsule 17 as shown in FIGS. 2 and 7. The three-phase wire 5197 of the first damper 519 is connected to the rectifier assembly 613. The electrical power produced by the first damper 519 is feed to the energy-consumption assembly 61 via the rectifier assembly 613. The cooperation of the first damper 519, the rectifier assembly 613 and the energy-consumption assembly 61 can automatically control the speed of the first escape capsule 7. That is, the three components constitute an automatic speed-control system. The rectifier assembly 613 can convert AC to DC for energy consumption and improve the security of the circuit to ensure the persons' safety. In this embodiment, the first damper 519 is a permanent three-phase damper, the rectifier assembly 613 is a three-phase parallel rectifier bridge, and the energy-consumption assembly 61 comprises a power-consumption resistor 611, a cooling fan 612 and a bulb 615 connected in parallel. The electric energy output by the permanent three-phase damper is rectified by the three-phase parallel rectifier bridge and then fed to the power-consumption resistor 611, the cooling fan 612 and the bulb 615. In an embodiment, the power-consumption resistor 611 has adjustable resistance values.

As shown in FIG. 6, the electric energy is consumed mainly by the power-consumption resistor 611 in the manner of heat energy and the rest of the electric energy is consumed by the cooling fan 612 and the bulb 615. The bulb 615 can illuminate the first escape capsule 7 for the trapped persons to enhance their sense of security. In an embodiment, the first damper 519 can be connected to an output power interface 614 for providing electric energy. The cooling fan 612 can be used to cool the power-consumption resistor 611 to take away the generated heat. Moreover, the bulb 615 consuming some of the electric energy can decrease the heat output from the power-consumption resistor 611. Thus, the temperature of each of the first damper 519, the power-consumption resistor 611 and the electromagnetic loop can be controlled under a predetermined value. This design can achieve the thermal balance so as to ensure that the first damper 519 is capable of continuously operating in normal capacity for a long distance. Therefore, the escape device for high-rise buildings of the present invention can be suitable for a building with relatively great height. It is understood by those skilled in the art, the escape device for high-rise buildings of the present invention may comprise an input power interface (not shown) for providing electric energy to the first damper 519 if required.

Referring to FIGS. 1 and 2, one or more first limiting wheels 6 are mounted on walls of the first escape capsule 7 for horizontally positioning the first escape capsule 7. At least a portion of each of the first limiting wheels 6 is tightly coupled with the first track 10 or second track 15 so that the first limiting wheels 6 is slidable along the first track 10 or second track 15. In this embodiment, there are eight first limiting wheels 6, four of which are disposed at the top of the first escape capsule 7 and the other four of which are disposed at the bottom of the first escape capsule 7. This design is to prevent the first escape capsule 7 from swinging or rotating during the descent.

As shown in FIG. 7, the first escape capsule 7 may further comprise an entrance rolling door 71 and an exit rolling door 72 for the trapped persons' entrance/exit. The entrance and exit rolling doors 71 and 72 and the limiting wheels 6 are provided for enhancing the security and stability of the escape device for high-rise buildings.

Referring back to FIG. 1, the escape device for high-rise buildings may further comprise a second escape capsule 5, a second damper, a third track, a fourth track and a pulley mechanism. The pulley mechanism comprises a cord 1, a first fixed pulley 3, a positioning pulley 9 and a second fixed pulley 8. The pulleys 3, 8 and 9 can be installed to the ceiling of a building. The second escape capsule 5 can carry the trapped persons in the same way as the first escape capsule 7 and move along a second channel formed between the third and fourth tracks. At lease one of the third and fourth tracks is installed with a second rack. In this embodiment, the second rack is installed to the third track. The second escape capsule 5 is provided with a second speed up gear engaged with the second rack. The movement of the second speed up gear is controlled by the second damper through a transmission mechanism. The two ends of the cord 1 of the pulley mechanism are connected with the first and second escape capsules 7 and 5, respectively.

The configuration of the second escape capsule 5 may be same to that of the first escape capsule 7. The escape device for high-rise buildings of the present invention can further comprise another brake assembly used to brake or hold on the second escape capsule 5, which is same to the one used to the first escape capsule 7. Furthermore, the second escape capsule 5 can be provided with second limiting wheels on its sidewalls for horizontally positioning the second escape capsule 5. At least a portion of each of the second limiting wheels is locked with the third or fourth tracks and the second limiting wheels can slide along the third or fourth tracks.

In an embodiment, the first, second, third and fourth tracks are designed to be I-shaped. The building can be provided with a harbor apartment in which the first, second, third and fourth tracks are installed. One or more doors 12 are provided in the harbor apartment for entering the escape capsules. In another embodiment, each floor of the building can be provided with a harbor apartment for escape.

Hereinafter, the operation of the escape device for high-rise buildings will be described in detail.

Normally, the first and second escape capsules 7 and 5 may be set at the top floor and ground, respectively. In the event of a disaster, persons trapped on the top floor get on the first escape capsule 7 through the entrance rolling door 71 and then close the door 71. Then, the first escape capsule 7 starts to run down by switching the operating handle 515 from its brake position 515*a* to its release position 515*b*. When the first escape capsule 7 lands onto the ground, the carried persons can get off through the exit rolling door 72. At the same time, the second escape capsule 5 initially placed on the ground have been pulled upwards by the cord 1 to the top floor. Referring to FIGS. 1-3, when the upper brake rod 521 of the second escape capsule 5 hits the ceiling of the building during moving up, the reset spring 525 will be compressed and then push the lower brake rod 518 down. The pushed lower brake rod 518 will successively push the push-rod 516 to switch the operating handle 515 from its release position 515*b* to its brake position 515*a* so that the second escape capsule 5 is stopped and held at the top floor. Then, the residual persons on the top floor can get on the second escape capsule 5 for escape. The process stated above can be repeated until all trapped persons are saved. Using the escape device for high-rise buildings of the present invention, a crowd of persons trapped in a building can save themselves without needing any assistance so as to save time.

By switching the operating handle 515 from its release position 515*b* to its brake position 515*a*, the first or second escape capsule also can be stopped at any floor to save the persons trapped thereon.

If one of the first and second escape capsules 7 and 5 is out of control or the cord 1 is broken off unexpectedly, the other can still be normally operated to carry the trapped persons onto the ground.

The present invention is not limited to the descriptions and embodiments mentioned above. Variations and modification made by those skilled in the art according to the disclosure herein should be within the scope of the present invention.

The invention claimed is:

1. An escape device for high-rise buildings, comprising:

an escape capsule;

a speed up gear mounted to the escape capsule;

a track provided with a rack with which the speed up gear is engaged so that the escape capsule can move along the track;

a damper including a rotor, wherein the speed up gear in operation drives the rotor into rotation and the damper is capable of converting a portion of kinetic energy of the escape capsule to electric energy; and further comprising a brake assembly which comprises:

a brake wheel connected to the rotor;

a brake-belt partially surrounding the brake wheel; and a brake operator configured to control the brake-belt to clasp or release the brake wheel.

2. The escape device of claim 1, wherein the brake operator comprises a tension-spring including a first end fixed to the escape capsule and a second end, a rotating-arm including a first end connected to the second end of the tension-spring and a second end, a brake-belt pulling rod connected between a joint of the tension-spring and the rotating-arm and the brake-belt, and an operating handle connected with the second end of the rotating-arm through a pull-cable, wherein the rotating-arm can be pulled by the tension-spring and the pull-cable to rotate about a rotating-arm fixing latch, and the operating handle can be switched between its release position and brake position.

3. The escape device of claim 2, further comprising an emergency stop mechanism which comprises an upper brake rod, a lower brake rod having a wedge-shaped lower end, a reset spring connected between the upper brake rod and the lower brake rod, and a push-rod comprising a first end adjacent to the wedge-shaped lower end and a second end adjacent to the release position of the operating handle, wherein when the upper brake rod is hit downward, the lower brake rod is pushed downward by the compressed reset spring, so that the wedge-shaped lower end push the push-rod to switch the operating handle from its release position to its brake position.

4. The escape device of claim 1, further comprising a load, wherein the electric energy generated by the damper is fed to the load.

5. The escape device of claim 4, wherein the load comprises an energy- consumption assembly and the electric energy generated by the damper is fed to the load.

6. The escape device of claim 5, further comprising a rectifier assembly, wherein the electric energy generated by the damper is feed to the energy-consumption assembly via the rectifier assembly.

7. The escape device of claim 6, wherein the energy-consumption assembly comprises a power-consumption resistor.

8. The escape device of claim 7, wherein the energy-consumption assembly further comprises a cooling fan connected with the power-consumption resistor in parallel and used for cooling the power-consumption resistor and/or the damper.

9. The escape device of claim 8, wherein the energy-consumption assembly further comprises a bulb connected with the power-consumption resistor in parallel and illuminating the escape capsule.

10. The escape device of claim 1, further comprising one or more limiting wheels mounted on the escape capsule, wherein the limiting wheels horizontally positions the escape capsule, at least a portion of each of the limiting wheels is tightly coupled with a first track or second track so as to horizontally position the escape capsule and the limiting wheels are slidable along the first track or second track.

11. An escape system for high-rise buildings comprising two escape devices, wherein each of the escape devices comprises:

an escape capsule;

a speed up gear mounted to the escape capsule;

a track provided with a rack with which the speed up gear is engaged so that the escape capsule can move along the track;

a damper including a rotor, wherein the speed up gear in operation drives the rotor into rotation and the damper is capable of converting a portion of kinetic energy of the escape capsule to electric energy; and wherein each of the escape devices further comprises a brake assembly including:

a brake wheel connected to the rotor, a brake-belt partially surrounding the brake wheel, and a brake operator configured to control the brake-belt to clasp or release the brake wheel.

12. The escape system of claim 11, wherein the brake operator comprises a tension-spring including a first end fixed to the escape capsule and a second end, a rotating-arm including a first end connected to the second end of the tension-spring and a second end, a brake-belt pulling rod connected between a joint of the tension-spring and the rotating-arm and the brake -belt, and an operating handle connected with the second end of the rotating-arm through a pull-cable, wherein the rotating-arm can be pulled by the tension- spring and the pull- cable to rotate about a rotating-arm fixing latch, and the operating handle can be switched between its release position and brake position.

13. The escape system of claim 12, wherein each of the escape devices further comprises an emergency stop mechanism which comprises an upper brake rod, a lower brake rod having a wedge-shaped lower end, a reset spring connected between the upper brake rod and the lower brake rod, and a push-rod comprising a first end adjacent to the wedge-shaped lower end and a second end adjacent to the release position of the operating handle, wherein when the upper brake rod is hit downward, the lower brake rod is pushed downward by the compressed reset spring, so that the wedge-shaped lower end push the push-rod to switch the operating handle from its release position to its brake position.

14. The escape system of claim 11, wherein each of the escape devices further comprises a load, and the electric energy generated by the damper is fed to the load.

* * * * *